US012492850B2

(12) United States Patent
Derosier et al.

(10) Patent No.: US 12,492,850 B2
(45) **Date of Patent: *Dec. 9, 2025**

(54) DIRECT EXPANSION EVAPORATOR WITH VAPOR EJECTOR CAPACITY BOOST

(71) Applicant: Evapco, Inc., Taneytown, MD (US)

(72) Inventors: Greg Derosier, Eldersburg, MD (US); Shridhar Gopalan, Westminster, MD (US)

(73) Assignee: Evapco, Inc., Taneytown, MD (US)

( * ) Notice: Subject to any disclaimer, the term of this patent is extended or adjusted under 35 U.S.C. 154(b) by 73 days.

This patent is subject to a terminal disclaimer.

(21) Appl. No.: 18/350,739

(22) Filed: Jul. 11, 2023

(65) Prior Publication Data

US 2024/0426531 A1 Dec. 26, 2024

Related U.S. Application Data

(63) Continuation-in-part of application No. 18/211,878, filed on Jun. 20, 2023, now abandoned.

(51) Int. Cl.
*F25B 43/00* (2006.01)

(52) U.S. Cl.
CPC ..... *F25B 43/006* (2013.01); *F25B 2341/0011* (2013.01); *F25B 2500/28* (2013.01)

(58) Field of Classification Search
CPC ..... F25B 43/006; F25B 2341/0011; F25B 2341/001; F25B 2341/00; F25B 2500/28; F25B 9/08
See application file for complete search history.

(56) References Cited

U.S. PATENT DOCUMENTS

2018/0119997 A1 5/2018 Siegert et al.
2020/0141620 A1 5/2020 Derosier et al.
2021/0372678 A1 12/2021 Engen
2023/0132248 A1 4/2023 Macdonald et al.

FOREIGN PATENT DOCUMENTS

CN 104501481 A * 4/2015 ..... F25B 25/00
CN 110345690 B * 5/2020

OTHER PUBLICATIONS

International Search Report issued in co-pending application No. PCT/US 23/75920, dated Feb. 16, 2024.

* cited by examiner

*Primary Examiner* — Miguel A Diaz
(74) *Attorney, Agent, or Firm* — Whiteford, Taylor & Preston, LLP; Peter J. Davis

(57) ABSTRACT

A system and method for increasing the refrigeration capacity of a direct expansion refrigeration system having a vapor separator and a vapor ejector. After the throttling process at the expansion device, the mixture of liquid and vapor enters the inlet separator. The vapor separator generates vapor to power the ejector through flashing of warm refrigerant liquid from a higher temperature and pressure to a lower pressure. The cooler refrigerant liquid then goes to the evaporator coil inlet. Furthermore, the system stabilizes the superheat of the outlet vapor and reduces fluctuations in outlet superheat caused by excess unevaporated liquid flowing from the outlets of the tubes due to maldistribution at the inlet.

1 Claim, 6 Drawing Sheets

DIRECT EXPANSION EVAPORATOR WITH VAPOR EJECTOR CAPACITY BOOST

BACKGROUND OF THE INVENTION

Field of the Invention

This invention relates to direct expansion refrigeration systems.

SUMMARY OF THE INVENTION

One of the drawbacks of direct expansion (DX) refrigeration technology when compared to pump overfeed systems is the reduction in cooling capacity due to the reduction in liquid refrigerant flow through the evaporator to achieve the superheat at the evaporator outlet.

The present invention is an improvement on current technology DX evaporators such that heat absorbing capacity is increased by increasing localized refrigerant flow. The liquid refrigerant flow is increased through local recirculation of liquid from evaporator outlet to evaporator inlet through a vapor ejector which pumps/entrains liquid refrigerant from a lower pressure to a higher pressure. This ejector is powered by the flash gas generated in the expansion device before the evaporator inlet.

The invention features a vapor ejector and separator combination that utilizes the flash gas generated from throttling to recycle additional refrigerant liquid from the evaporator outlet to the evaporator inlet. The flash gas generated in DX systems can vary from 5 to 15% or more of the total mass flow rate entering the evaporator. The flash gas is considered mostly a parasitic loss since it does not play a role in the evaporation process (the liquid refrigerant is the key player). This invention enables employing the above flash gas to increase the capacity of the evaporator by recirculating additional liquid through the evaporator. The increased liquid improves heat transfer through higher internal surface contact with boiling liquid. The technique is a regenerative method which utilizes flash gas to boost capacity.

The invention includes a vapor-liquid separator and a vapor ejector. After the throttling process, as in a standard refrigeration cycle, the mixture of liquid and vapor enters the vapor-liquid separator (hereinafter "inlet separator"). The inlet separator provides vapor to power the ejector through flashing of warm refrigerant liquid from a higher temperature and pressure to a lower pressure. The cooler refrigerant liquid goes to the evaporator inlet as in a normal DX system. The refrigerant vaporized in the throttling process is delivered to the vapor ejector as the motive flow. The vapor ejector pulls cold refrigerant liquid from the outlet of the evaporator into the side port of the ejector. The cold refrigerant liquid and motive vapor flow may be separated at an outlet separator or they may be both sent from the ejector to the evaporator. An expansion valve responsive to refrigerant vapor superheat, after the point where cold refrigerant liquid is collected, would typically be used to adjust inlet liquid flows to the evaporator.

Figure 1:
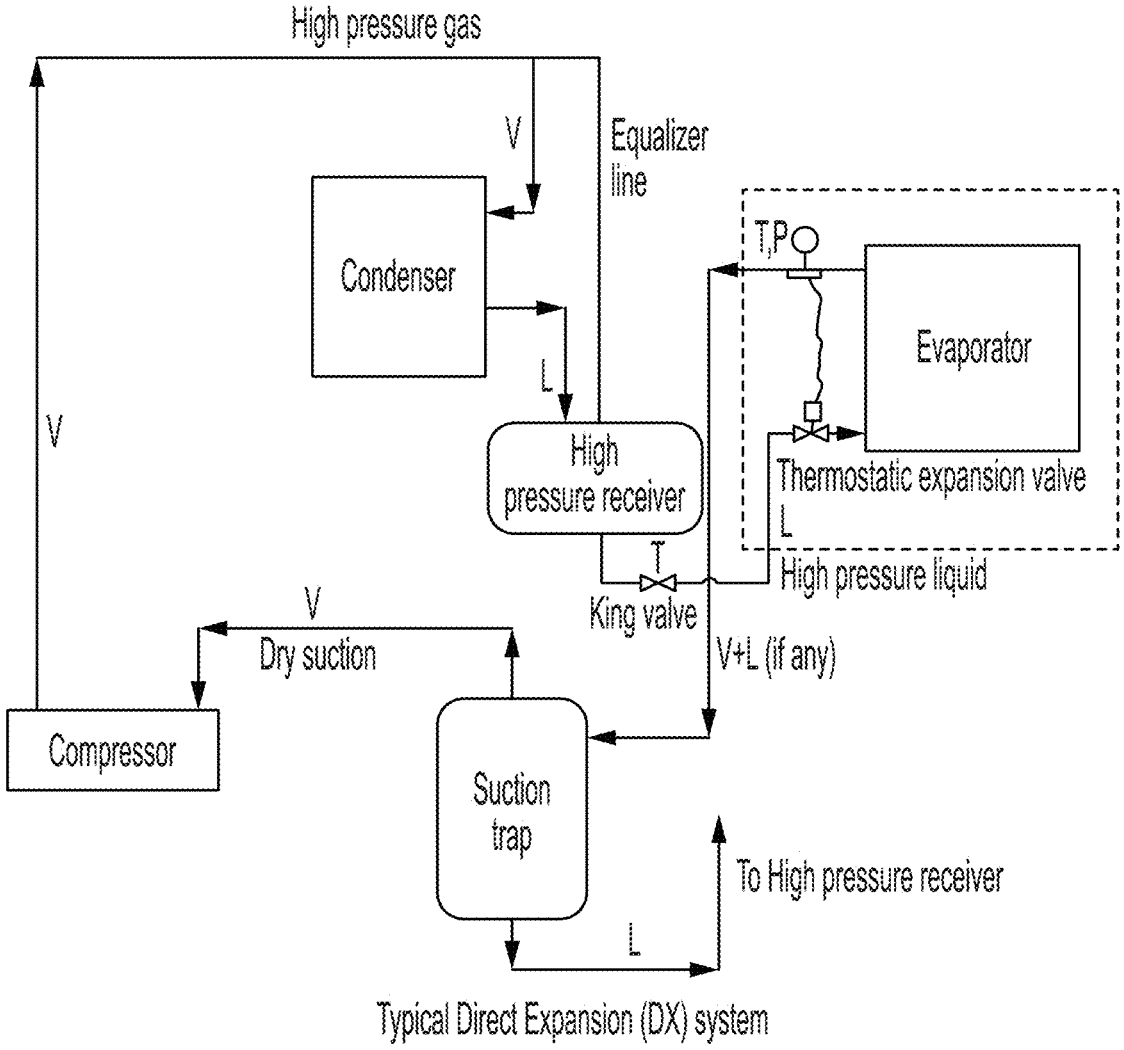
FIG. 1 is a representation of a standard direct expansion refrigeration system.

Features in the attached drawings are numbered with the following reference numerals:

| | |
|---|---|
| 3 | expansion device. |
| 5 | expansion device outlet |
| 7 | refrigerant line |
| 9 | inlet to inlet separator |
| 11 | inlet separator |
| 13 | inlet separator vapor outlet |
| 15 | inlet separator liquid outlet |
| 16 | refrigerant line |
| 17 | distributor inlet |
| 18 | refrigerant line |
| 19 | distributor |
| 20 | distributor side port |
| 21 | distributor outlet |
| 23 | evaporator inlets |
| 25 | evaporator |
| 26 | refrigerant line |
| 27 | evaporator outlet |
| 29 | refrigerant line |
| 30 | refrigerant line |
| 31 | ejector vapor inlet |
| 33 | ejector |
| 35 | ejector liquid inlet |
| 37 | ejector outlet |
| 39 | refrigerant line |
| 41 | outlet separator inlet |
| 43 | outlet separator |
| 45 | outlet separator liquid outlet |
| 46 | refrigerant line |
| 47 | outlet separator vapor outlet |
| 49 | refrigerant line |
| 50 | liquid header inlet |
| 51 | liquid header |
| 53 | liquid header first outlet |
| 55 | liquid header second outlet |
| 57 | refrigerant line |
| 59 | outlet separator second inlet |
| 100 | superheat sensor |
| 102 | controller |
| 103 | refrigerant line |

DETAILED DESCRIPTION

FIG. 1 shows a typical or standard direct expansion (DX) refrigeration system. High pressure, cooled refrigerant from high pressure receiver enters the evaporator through a thermostatic expansion valve and a distributor. The thermostatic expansion valve regulates (opens or closes) based on the superheat of the outlet vapor with the goal of generating superheated vapor (superheat≥6° F.) to ensure dry suction for the compressor. However, this is not the case in practice, as unevaporated liquid tends to escape the evaporator resulting in reduction in superheat and closing of the thermostatic expansion valve to reduce the refrigerant flow rate. This reduces refrigeration capacity. Furthermore, there is also a need for a suction trap as shown in FIG. 1 to trap any liquid and ensure dry suction to the compressor.

A DX system as described above, which uses a distributor to distribute liquid to all circuits of the evaporator is also sensitive to mal-distributions. Non-uniform distribution results in excess liquid flowing out of some circuit outlets, which will reduce superheat below target. This causes the thermostatic expansion valve to increase superheat back to target at the cost of reduced capacity.

Figure 2:
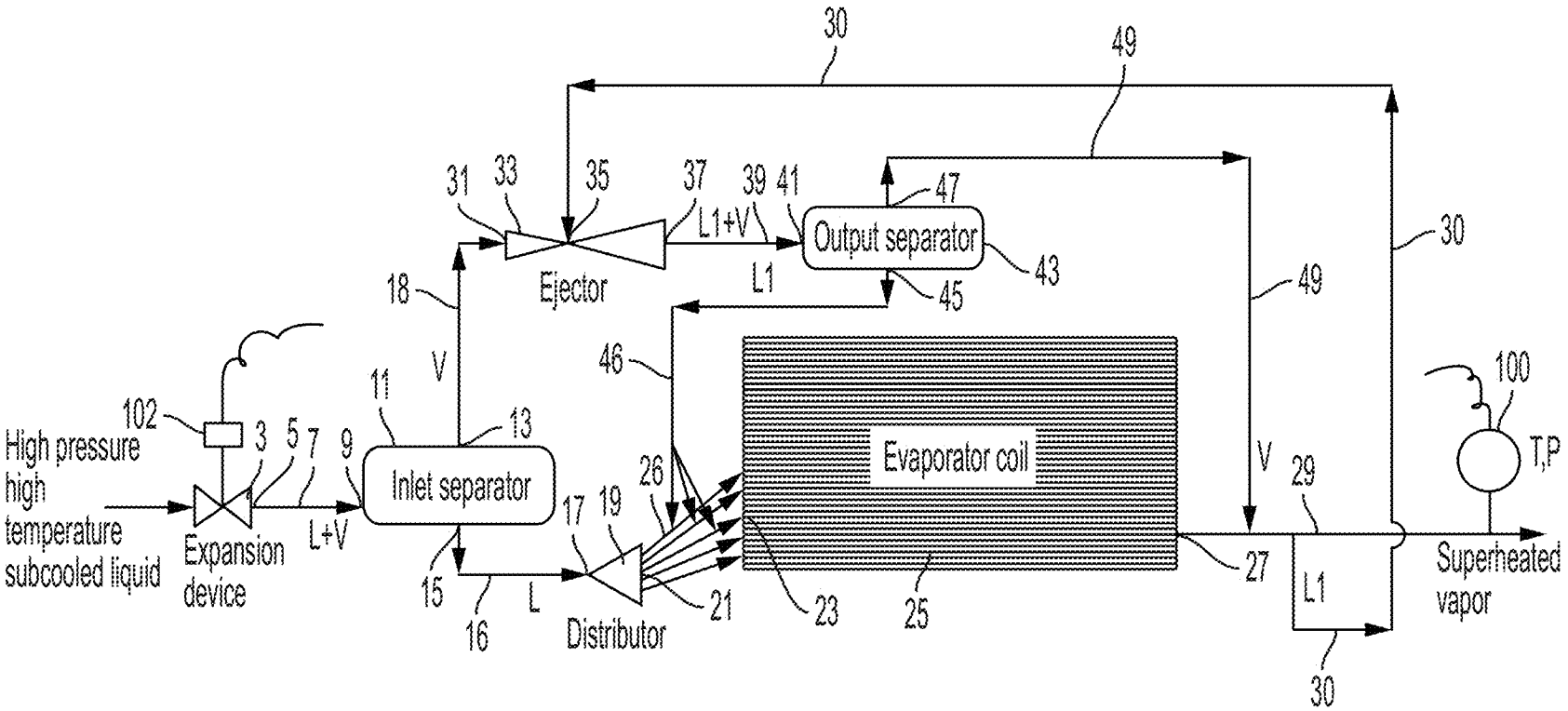
FIG. 2 is a representation of a direct expansion evaporator with vapor ejector capacity boost according to an embodiment of the invention.

FIG. 2 shows the portion of a DX refrigeration system of the invention which replaces the portion of a prior art DX refrigeration system that is enclosed in dashed lines in FIG. 1. Referring to the embodiment of FIG. 2, high pressure, cooled refrigerant is delivered to expansion device 3. The outlet 5 of the expansion device 3 is connected via refrigerant line 7 to the inlet 9 of a vapor-liquid separator 11 (referred to herein as inlet separator), which sends vapor flash gas received from the expansion device to inlet 31 of an ejector 33, while liquid refrigerant is sent to the inlet 17 of distributor 19 via refrigerant line 16. Distributor outlets 21 are connected to the evaporator coil 25 via refrigerant lines 26 for delivery of refrigerant liquid to the evaporator coil 25. While an evaporator coil is used as an example herein, any type of evaporator may be used in connection with the invention. Outlet 27 of the evaporator coil 25 produces both superheated vapor and unevaporated liquid. The superheated vapor is sent to the suction trap and/or compressor via refrigerant line 29, and the unevaporated liquid is sent to the liquid inlet 35 of the ejector 33 via refrigerant line 30. Sensor 100 measures the temperature and pressure of the superheated vapor and sends it to controller 102 to determine whether superheat has been achieved. Controller 102 causes the expansion device to open or close depending on the superheat determination.

Meanwhile, ejector 33 uses the flash gas received from the outlet 13 of inlet separator 11 to entrain or "pump" the unevaporated liquid, and the outlet 37 of the ejector 33 delivers the entrained refrigerant liquid and excess flash gas to the inlet 41 of a vapor-liquid separator 43 (referred to herein as outlet separator) via refrigerant line 39. The outlet separator 43 separates the vapor from the liquid and sends the liquid back to the evaporator coil 25 via a liquid outlet 45 and corresponding refrigerant line 46. Vapor leaves outlet 47 and joins the vapor leaving the outlet 27 of the evaporator coil 25 via refrigerant line 49. According to this arrangement, the DX system of the invention may provide excess liquid to the evaporator coil in order to maximize refrigeration capacity, but excess liquid leaving the evaporator coil is captured, redirected and reheated before being re-delivered to the evaporator coil, thereby preventing damage to the compressor.

Figure 3:
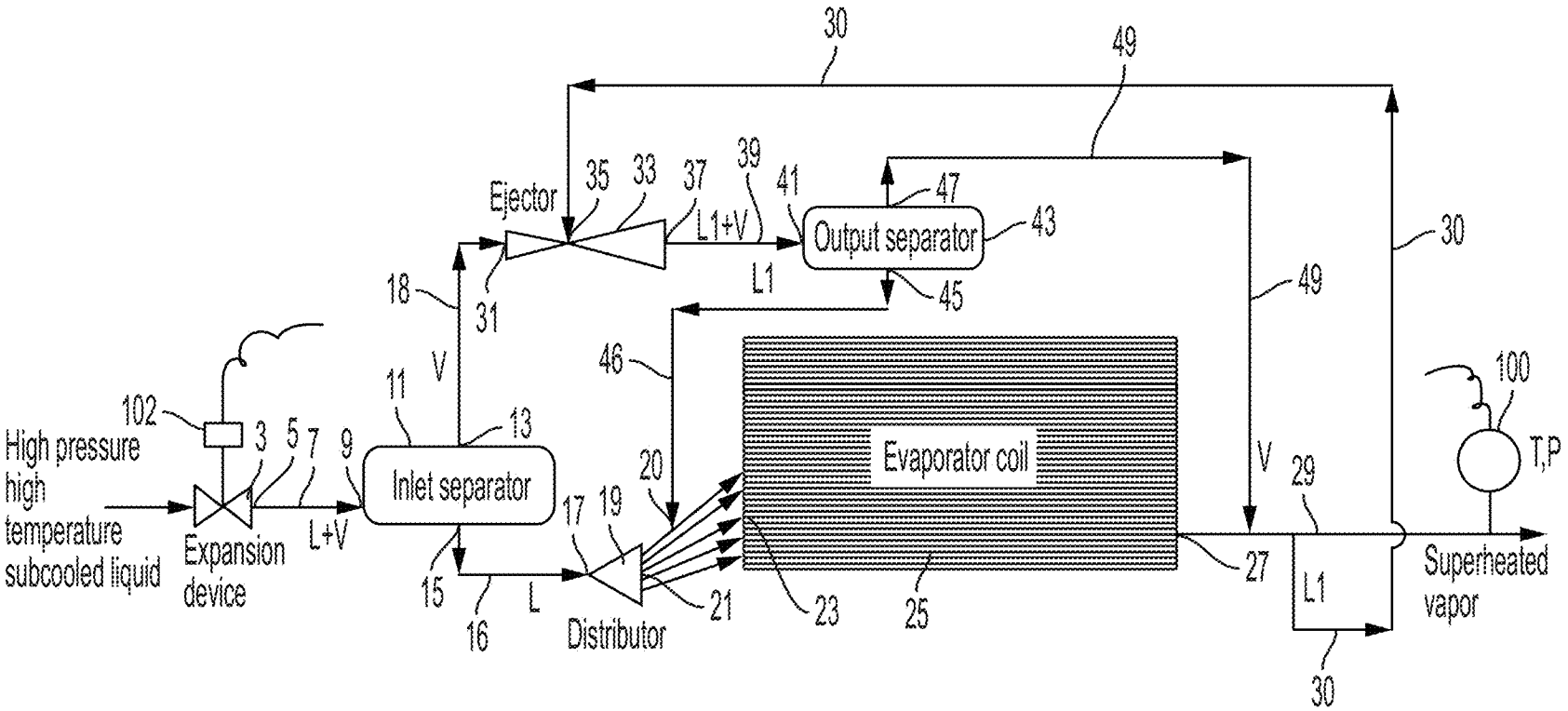
FIG. 3 is a representation of a direct expansion evaporator with vapor ejector capacity boost according to another embodiment of the invention.

FIG. 3 shows a variation of the embodiment shown in FIG. 2, in which the liquid outlet 45 from the outlet separator 43 connected to a side port 20 of the distributor 19 via refrigerant line 46.

Figure 4:
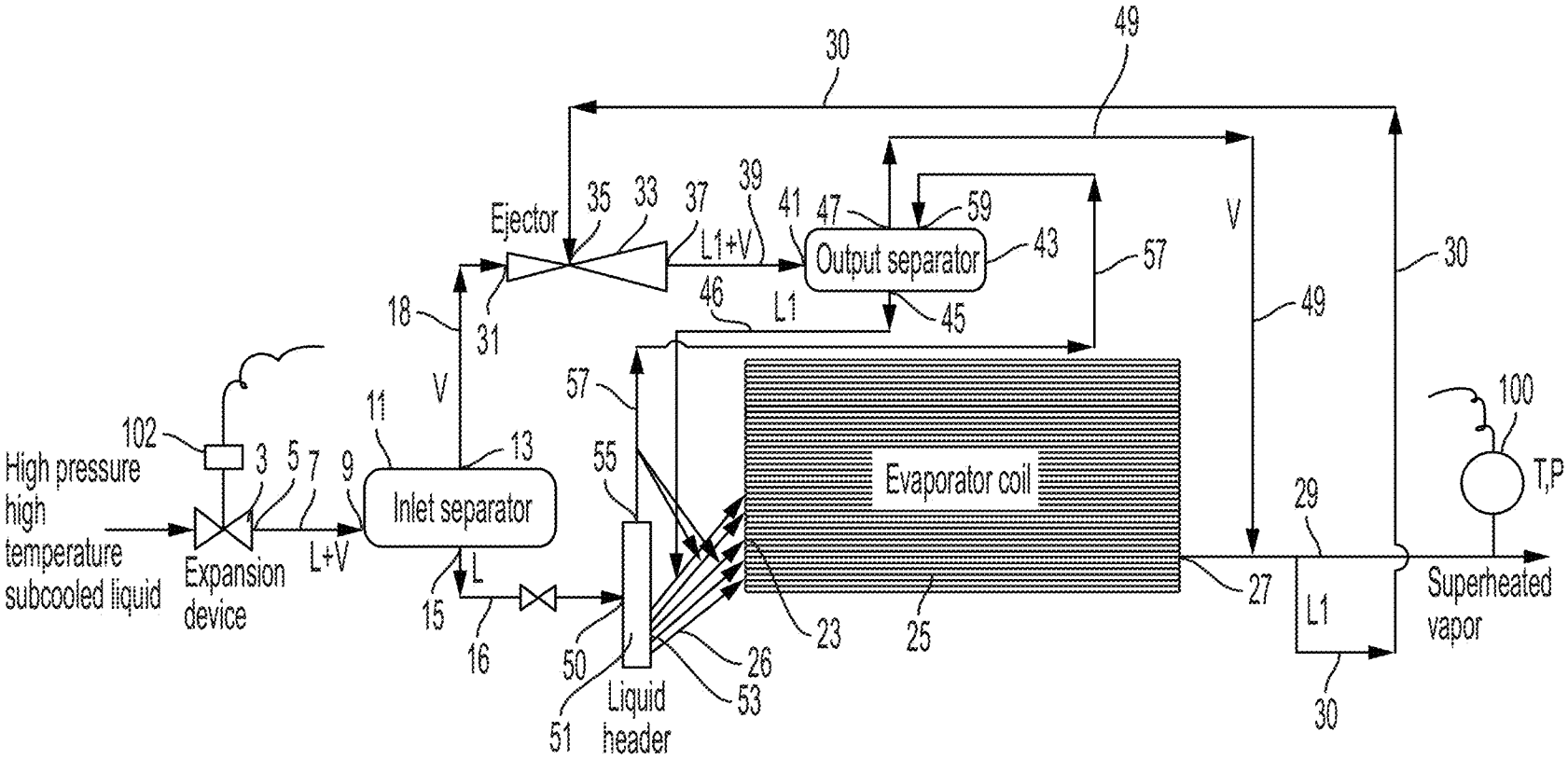
FIG. 4 is a representation of a direct expansion evaporator with vapor ejector capacity boost according to another embodiment of the invention.

FIG. 4 shows an alternate embodiment in which the distributor 19 of the embodiment shown in FIG. 2 is replaced with a liquid header 51. According to this embodiment, inlet separator 11 sends liquid refrigerant to the inlet 50 of liquid header 51 via refrigerant line 16. Liquid header has first outlets 53 and a second outlet 55. First outlets 53 are connected directly or indirectly to the evaporator coil 25, and second outlet 55 is connected to a second inlet 59 of the outlet separator 43 via refrigerant line 57 for providing additional excess liquid to the outlet separator 43. As with the embodiment of FIG. 2, the outlet 45 of outlet separator 43 is connected to the inlet 23 of evaporator coil 25 via refrigerant line 46.

Figure 5:
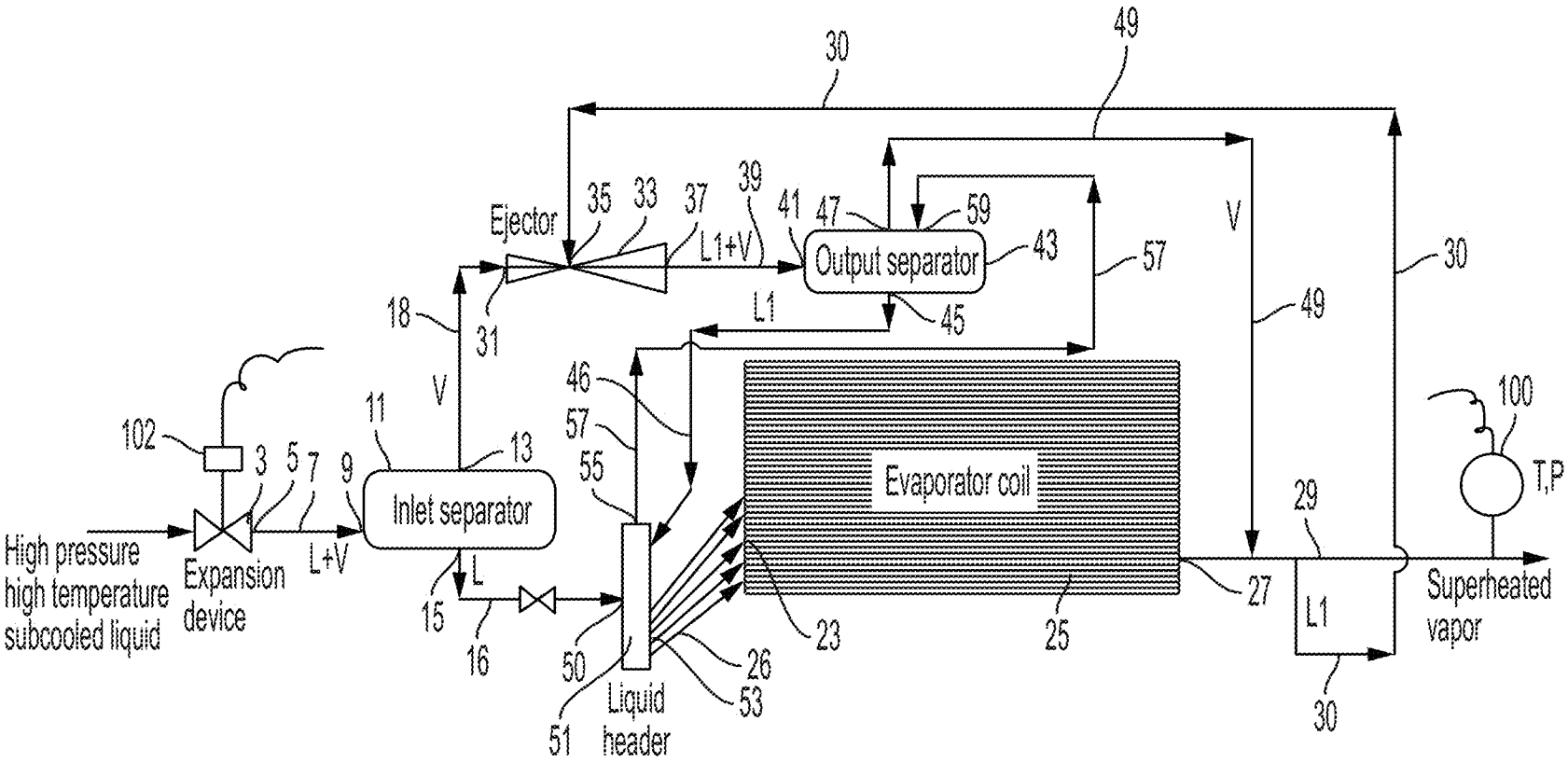
FIG. 5 is a representation of a direct expansion evaporator with vapor ejector capacity boost according to another embodiment of the invention.

FIG. 5 shows a variation of the embodiment shown in FIG. 4 in which outlet 45 of outlet separator 43 is connected directly to the liquid header 51 via refrigerant line 46.

Figure 6:
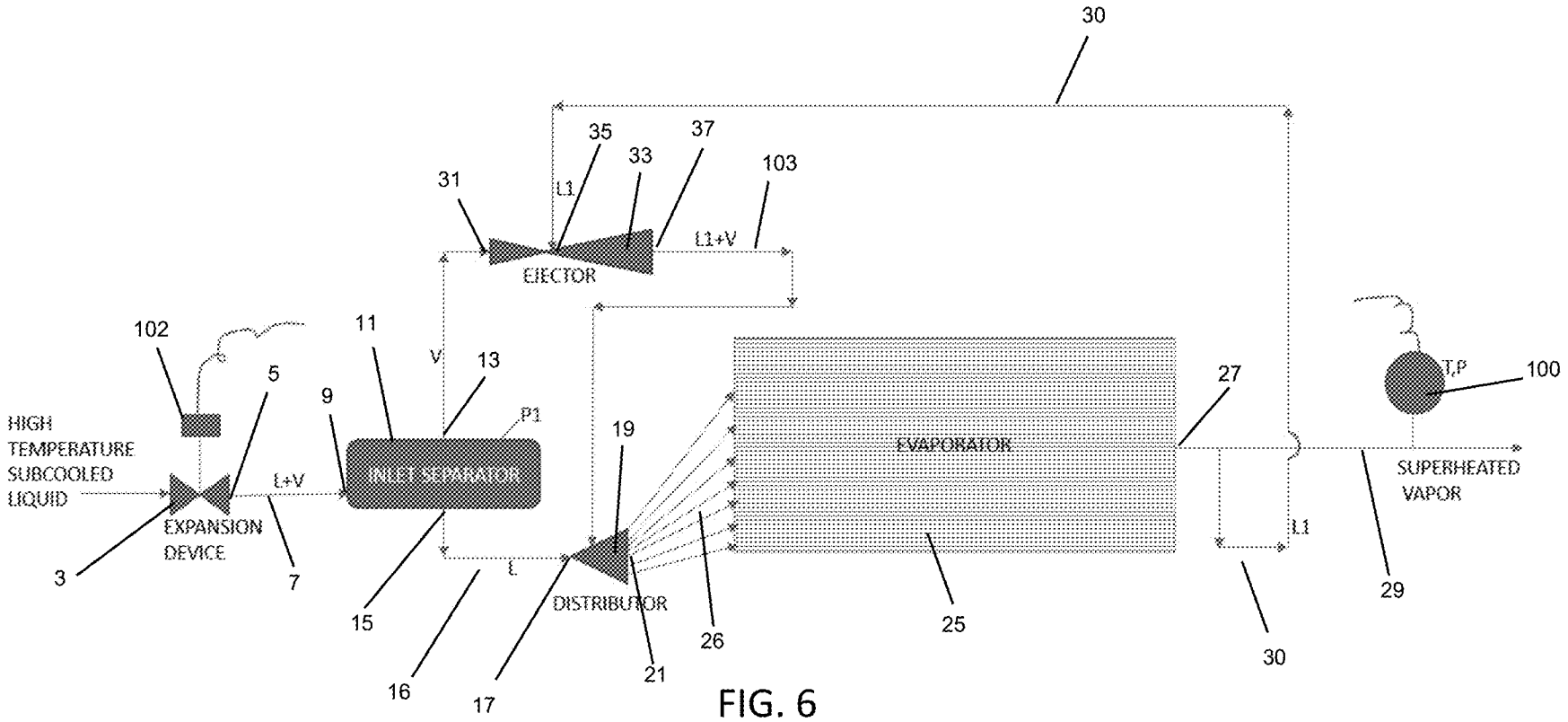
FIG. 6 is a representation of a direct expansion evaporator with vapor ejector capacity boost according to a further embodiment of the invention.

FIG. 6 shows an embodiment in which an outlet separator is not employed, and both the liquid and vapor leaving the ejector is sent to the evaporator. Referring to the embodiment of FIG. 6, high pressure, cooled refrigerant is delivered to expansion device 3. The outlet 5 of the expansion device 3 is connected via refrigerant line 7 to the inlet 9 of an inlet separator 11, which sends vapor flash gas received from the expansion device to inlet 31 of an ejector 33, while liquid refrigerant is sent to the inlet 17 of distributor 19 via refrigerant line 16. Distributor outlets 21 are connected to the evaporator coil 25 via refrigerant lines 26 for delivery of refrigerant liquid to the evaporator coil 25. While an evaporator coil is used as an example herein, any type of evaporator may be used in connection with the invention. Outlet 27 of the evaporator coil 25 produces both superheated vapor and unevaporated liquid. The superheated vapor is sent to the suction trap and/or compressor via refrigerant line 29, and the unevaporated liquid is sent to the liquid inlet 35 of the ejector 33 via refrigerant line 30. Sensor 100 measures the temperature and pressure of the superheated vapor and sends it to controller 102 to determine whether superheat has been achieved. Controller 102 causes the expansion device to open or close depending on the superheat determination.

Meanwhile, ejector 33 uses the flash gas received from the outlet 13 of inlet separator 11 to pump/entrain the unevaporated liquid, and the outlet 37 of the ejector 33 delivers the entrained refrigerant liquid and excess flash gas to the distributor 19.

While the inlet separator, the ejector, and, in the case of the embodiments of FIGS. 2-5, the outlet separator, are shown in the exemplary figures and description as constituting separate structure elements, two or more of them may be optionally combined into an integrated refrigerant recycling device which carries out the functions of all three devices.

The invention claimed is:

1. A method for increasing the refrigeration capacity of a direct expansion refrigeration system without risking liquid refrigerant damage to a compressor comprising the following steps, simultaneously:

taking liquid from an outlet of an evaporator and delivering it to an ejector, taking refrigerant vapor from an inlet separator located upstream of the evaporator and delivering it to said ejector, using said ejector to warm said refrigerant liquid received from said evaporator with said vapor received from said inlet separator, and taking all liquid and vapor from said ejector and delivering it to said evaporator.

* * * * *